US011369532B2

(12) United States Patent
Wilson et al.

(10) Patent No.: US 11,369,532 B2
(45) Date of Patent: Jun. 28, 2022

(54) ADJUSTABLE ANATOMICAL SUPPORT AND SEAT CUSHION APPARATUS FOR WHEELCHAIRS

(71) Applicant: SUPRACOR, INC., San Jose, CA (US)

(72) Inventors: Susan L. Wilson, San Jose, CA (US); Curtis L. Landi, San Jose, CA (US)

(73) Assignee: SUPRACOR, INC., San Jose, CA (US)

( * ) Notice: Subject to any disclaimer, the term of this patent is extended or adjusted under 35 U.S.C. 154(b) by 329 days.

(21) Appl. No.: 16/583,251

(22) Filed: Sep. 25, 2019

(65) Prior Publication Data

US 2021/0085544 A1 Mar. 25, 2021
US 2021/0205155 A9 Jul. 8, 2021

Related U.S. Application Data

(60) Provisional application No. 62/736,452, filed on Sep. 25, 2018.

(51) Int. Cl.
*A61G 5/10* (2006.01)

(52) U.S. Cl.
CPC ..... *A61G 5/1045* (2016.11); *A61G 5/1091* (2016.11)

(58) Field of Classification Search
CPC ..... A61G 5/00; A61G 5/10; A61G 5/1043; A61G 5/1045; A61G 5/1091
See application file for complete search history.

(56) References Cited

U.S. PATENT DOCUMENTS 4,031,579 A 6/1977 Larned
4,143,916 A * 3/1979 Trotman ..... A47C 7/74 297/452.45
4,522,447 A 6/1985 Snyder et al.
5,039,567 A 8/1991 Landi et al.
5,180,619 A 1/1993 Landi et al.
5,203,607 A 4/1993 Landi
5,378,045 A 1/1995 Siekman et al.
5,444,881 A 8/1995 Landi et al.
5,617,595 A 4/1997 Landi et al.
(Continued)

FOREIGN PATENT DOCUMENTS

AT 509326 A4 8/2011

OTHER PUBLICATIONS

Machine translation of AT 509326 A4.
(Continued)

*Primary Examiner* — Fredrick C Conley
(74) *Attorney, Agent, or Firm* — Klintworth & Rozenblat IP LLP

(57) ABSTRACT

An adjustable anatomical support and seat cushion apparatus for wheelchairs and the like, including a resilient, cellular thermoplastic honeycomb seat cushion member and a pivotally attached base member forming a planar base upon which the cushion member will rest when folded about the attaching pivot to engage and lay thereupon. Positioned upon and secured to the base member and disposed between it and the overlying cushion member, are user or therapist positionable, prescriptively sized and shaped pelvic obliquity elements, pommel elements and/or wedge elements operative to deform the cushion member when engaged with the bottom thereof. The assembly of components is contained within a suitable fabric cover envelope.

22 Claims, 5 Drawing Sheets

(56) References Cited

U.S. PATENT DOCUMENTS

| | | | | |
|---|---|---|---|---|
| 5,687,436 | A * | 11/1997 | Denton | A47C 31/126 5/653 |
| 5,840,400 | A | 11/1998 | Landi et al. | |
| 6,142,563 | A | 11/2000 | Townsend et al. | |
| 6,901,617 | B2 * | 6/2005 | Sprouse, II | A47C 4/54 297/219.1 |
| 7,717,520 | B2 | 5/2010 | Boren et al. | |
| 7,871,039 | B2 | 1/2011 | Fullerton et al. | |
| 8,793,821 | B2 | 8/2014 | Fowkes et al. | |
| 9,532,912 | B2 | 1/2017 | Loewenthal et al. | |
| 9,708,067 | B2 | 7/2017 | Wilson et al. | |
| 2003/0061663 | A1 | 4/2003 | Lampel | |
| 2005/0231014 | A1 | 10/2005 | Carlisle | |
| 2009/0295203 | A1 | 12/2009 | Lewis et al. | |

OTHER PUBLICATIONS

International Preliminary Report on Patentability for International Patent Application No. PCT/IB2019/001463 dated Apr. 16, 2021, 39 pages.

International Search Report for International Patent Application No. PCT/IB2019/001463 dated Oct. 16, 2020, 2 pages.

International Written Opinion for International Patent Application No. PCT/IB2019/001463 dated Oct. 16, 2020, 4 pages.

'Pressure Reducing chair Cusion—Comfort Cushion Seat Pad for Wheelchair, Arm Chair, Patio Chair—Machine Wash Polyester/Cotton—Navy Blue' (EasyComforts), Aug. 18, 2017 (Aug. 18, 2017), [online], previously retrieved from <URL: https://www.amazon.com/Pressure-Reducing-Cushion-for-Wheelchairs/dp/B078PXBFL2/ref=pd_lpo_121_t_2/130-7786592-9163630?_encoding=UTF8&pd_rd_r=5ad457ca-d3fa-4fcf-description continued in 5.

Description continued from 4: a5a7-6044f547583d&pd_rd_w=12epa&pd_rd_wg=hKgCQ&pf_rd_p=7b36d496-f366-4631-94d3-61b87b5s511b&pf_rd_r=EVST5XQ8ZHJPFHW7CCE6&refRID=EVST5XQ8ZHJPFHW7CCE6&th=1> and currently from <https://www.amazon.com/Pressure-Reducing-Cushion-for-Wheelchairs/dp/B078PXBFL2>, entire document.

Pressure Reducing chair Cusion—Comfort Cushion Seat Pad for Wheelchair, Arm Chair, Patio Chair—Machine Wash Polyester/Cotton—Navy Blue (EasyComforts), Jul. 12, 2021, [online], previously retrieved from <URL: https://www.amazon.com/Pressure-Reducing-Cushion-for-Wheelchairs/dp/B078PXBFL2/ref=pd_lpo_121_t_2/130-7786592-9163630?_encoding=UTF8&pd_rd_r=5ad457ca-d3fa-4fcf-description continued in 2.

Description continued from 1: a5a7-6044f547583d&pd_rd_w=12epa&pd_rd_wg=hKgCQ&pf_rd_p=7b36d496-f366-4631-94d3-61b87b5s511b&pf_rd_r=EVST5XQ8ZHJPFHW7CCE6&refRID=EVST5XQ8ZHJPFHW7CCE6&th=1> and currently from <https://www.amazon.com/Pressure-Reducing-Cushion-for-Wheelchairs/dp/B078PXBFL2>, entire document.

* cited by examiner

OPTIMAL POSTURE

PELVIC OBLIQUITY

ANTERIOR PELVIC TILT

POSTERIOR PELVIC TILT

PELVIC ROTATION

ADJUSTABLE ANATOMICAL SUPPORT AND SEAT CUSHION APPARATUS FOR WHEELCHAIRS

BACKGROUND OF THE INVENTION

Field of the Invention

The present invention relates generally to anatomical support cushions adapted for use in improving pelvic and spinal alignment issues during use of a wheelchair apparatus.

Brief Statement of the Prior Art Problems to be Addressed by the Present Invention Non-ambulatory patients suffering with minor illness or simple leg bone injuries, or the like, do not normally require the use of special purpose wheelchair cushions. However, in those long term care (LTC) cases where the patient suffers from serious postural injury or physical conditions involving pelvic or spinal related abnormalities expressing pelvic obliquity issues, anterior pelvic tilt issues, posterior and/or pelvic tilt issues, or pelvic rotation issues, the use of specially configured cushioning or other body positioning, orienting or supporting means may be required. The present invention is intended to address this need and to provide an adjustable wheelchair cushion that can be specified, prescribed and/or used by LTC therapists to improve the efficacy of wheelchair cushioning used in this environment.

The following is included to provide background information relating to some of the postural abnormalities toward which the present invention is directed, and how an LTC therapist has sought to provide, or has in fact provided, patient relief during use of a standard wheelchair and cushioning means.

Terms Used Herein

LTC: Long Term Care

Lordosis: an abnormal forward curvature of the spine in the lumbar region, resulting in a swaybacked posture.

Kyphosis: an abnormal, convex curvature of the spine, with a resultant bulge at the upper back.

Scoliosis: an abnormal lateral curvature of the spine.

Oblique:

neither perpendicular nor parallel to a given line or surface; slanting; sloping.

(of a solid) not having the axis perpendicular to the plane of the base.

diverging from a given straight line or course.

Obliquity: the state of being oblique.

Cervical: of or relating to the cervix or neck.

Lumbar: of or relating to the loin or loins.

Loin: the part or parts of the human body or of quadruped animal on either side of the spinal column, between the false ribs and hipbone.

Thorax: the part of the trunk in humans and higher vertebrates between the neck and the abdomen, containing the cavity, enclosed by the ribs, sternum, and certain vertebrae, in which the heart, lungs, etc., are situated; chest.

Spine: the spinal or vertebral column; backbone.

Sacrum: a bone resulting from the fusion of two or more vertebrae between the lumbar and the coccygeal regions, in humans being composed usually of five fused vertebrae and forming the posterior wall of the pelvis.

ELR: Elevating Leg rest

STFH: Seat-to-Floor Height

MWC: Manual Wheelchair

IT: Ischial Tuberosity

PSIS: Posterior Superior Iliac Spine

ASIS: Anterior Superior Iliac Spine

LE: Lower Extremity

UE: Upper Extremity

ROM: Range of Motion

ADLs: Activities of Daily Living

PPT: Posterior Pelvic Tilt

OPTIMAL POSTURE—generally depicted in FIG. 2 of the Drawings

Pelvis in midline.

ASIS & PSIS at equal height: no pelvic tilt.

L ASIS & R ASIS at equal height: no obliquity.

L ASIS & R ASIS at equal depth: no rotation.

Spine balanced and upright, no rotation, no lateral curvature.

Normal lordosis in cervical and lumbar spine and normal kyphosis in thoracic spine creating the desired "S" shape.

The head is functionally upright with only mild forward/lateral flexion or rotation.

PELVIC OBLIQUITY—generally depicted in FIG. 3 of the Drawings

In patients with this abnormality, the pelvis sits with the L or R ASIS higher than the other, causing the raising up of one hip. When one side of the pelvis is raised higher than the other, the thoracic spine curves away from the higher side creating a scoliosis over time. The neck will go into lateral flexion as if the person is dropping the ear to his or her shoulder. The lateral flexion will usually be towards the side where the hip is higher. Pressure redistribution is the therapist's support goal whether the deformity is FIXED or FLEXIBLE.

If FLEXIBLE: level the pelvis by building up the lower side.

If FIXED: accommodate for the deformity. Protect the bony prominences from pressure by "filling in" the higher side and immersing the lower side IT.

ANTERIOR PELVIC TILT—generally depicted in FIG. 4 of the Drawings

In patients with this abnormality, the pelvis sits with ASIS higher than the PSIS resulting in the posterior pelvic tilt which produces the sacral sitting posture. With excessive thoracic lordosis of the lumbar and cervical spine the patient hyperextends his or her back over the sling back of the chair, placing him or her at risk to tip the chair backwards.

Excessive lordosis of cervical spine causes hyperextension of the neck and upward eye gaze.

With this abnormality, the goal is normally to utilize a cushion and back support that maximizes contact with the seat surface for optimal pelvic and spinal stability and pressure redistribution.

Stability is the goal, so a back support is normally used that is tall enough for the patient.

Measurements are made from seat surface to the top of shoulder. A moldable back support to conform to the curvature of the spine is normally used.

POSTERIOR PELVIC TILT—generally depicted in FIG. 5 of the Drawings

With this abnormality, the pelvis sits with ASIS higher than the PSIS resulting in the posterior pelvic tilt which produces the sacral sitting posture. Excessive thoracic kyphosis, producing "C" shape spine, "flattening out" of the lordosis of the cervical spine and "flattening out" of the lordosis of the lumbar spine.

Decreased lordosis in cervical spine, causing forward neck flexion & downward eye gaze to floor/lap. A cushion with medial and lateral contour is often used to promote LE alignment and pelvic stability. Appropriate cushion depth should be used to prevent the patient from sliding forward as he seeks reduced pressure behind the knees. A rigid insert is often used to prevent hammocking of the seat and cushion and to keep the pelvis from collapsing into a posterior pelvic tilt.

If FLEXIBLE: A cushion with tapered adductors can be used to load the trochanters, stabilizing the pelvis in the resident's most neutral alignment.

If FLEXIBLE: A cushion with an anti-thrust component can be used to reduce forward sliding of the pelvis into posterior pelvic tilt.

If FIXED: An immersion style cushion that contours to the shape of the patient can be used to promote maximum pressure redistribution, minimizing peak pressures.

If FIXED: Opening seat-to-back angle in conjunction with a fixed tilt in the wheelchair, is often used to match the patient's ROM limitations and minimize forward sliding.

Objects of this Invention

An object of the present invention is to provide an adjustable anatomical support and seat cushion apparatus that can be adapted to accommodate the particular anatomical support needs of a user/patient having postural abnormalities.

Another object of the present invention is to provide an improved anatomical support and seat cushion apparatus including at least one thermoplastic elastomer honeycomb cushion panel and a plurality of selectable inserts that serve to conform, support and/or stabilize a wide variety of wheelchair user sitting positions, user anatomies and disabilities.

Another object of the present invention is to provide an improved adjustable anatomical support cushion apparatus for providing pelvic and trunk stability for a wheelchair user having postural abnormalities.

Still another object of the present invention is to provide an adjustable anatomical support cushion apparatus for maximizing functional activities of daily living for a wheelchair user having postural abnormalities.

Yet another object of the present invention is to provide an improved anatomical support cushion apparatus for protecting skin and preventing wounds, and/or promoting the healing of existing wounds suffered by a wheelchair user having postural abnormalities.

A further object of the present invention is to provide an adjustable support cushion apparatus for maximizing comfort for a wheelchair user having postural abnormalities.

Another object of the present invention is to provide an adjustable anatomical support and seat cushion apparatus for minimizing unwanted skeletal movement by a wheelchair user having postural abnormalities.

Yet another object of the present invention is to provide an adjustable support cushion for preventing progression of postural abnormalities.

A still further object of the present invention is to provide an adjustable anatomical support apparatus that is breathable to permit cooling of the user.

Another object of the present invention is to provide an adjustable anatomical support and seat cushion apparatus that can be tailored to create certain desired cushioning and stabilizing characteristics without having to introduce padding elements such as foams, fluids or other means which add cost or reduce durability.

Still another object of the present invention is to provide an adjustable anatomical support apparatus constructed of materials that are fast-drying, and can be easily disinfected and sterilized by chemical wash, microwave treatment, detergent wash, or other means.

SUMMARY OF THE INVENTION

Briefly stated, the present invention is directed to an adjustable, anatomical support and wheelchair seat cushion apparatus including a resilient thermoplastic honeycomb seat cushion member and a pivotally attached base member forming a planar base upon which the seat cushion member will rest be deformed when folded about the pivot to engage and lay thereupon. The base member may also be made of one or more layers of a more rigid thermoplastic honeycomb material. Positioned upon the base member and disposed between it and the overlying seat cushion member are user and/or LTC therapist installable, prescriptively sized and shaped pelvic obliquity elements, pommel elements and/or wedge elements, or the like, operative to deform the cushion member when engaged therewith. Once the obliquity, pommel and/or wedge elements are positioned and affixed to the base member, the cushion member is rotated into engagement therewith and deformed thereby, and the assembly is inserted into its fabric cover, a closing zipper or the like is retracted and the cushion apparatus is ready for use. In some cases, an ischial pad may also be inserted into a pocket provided in the back-center portion of the cover to protect the patient's ischial bone.

An important advantage of the present invention is that the thermoplastic elastomeric honeycomb material used in the construction of the apparatus is an anisotropic material having improved pressure relief, stability, compression set resistance, durability and low maintenance characteristics.

Another advantage of the present invention is that in fitting the cushion apparatus for a particular user, an LTC therapist may select from a wide variety of preformed shaping elements and cushion positions therefor to customize and individually tailor the cushion apparatus for the user.

Yet another advantage of the present invention is that a single size and shape of cushion can be matched with a variety of individually selectable, preformed shaping elements to support the specific requirements of a particular wheelchair user.

Still another advantage of the present invention is that the anatomical support apparatus may be constructed from a perforated core thermoplastic elastomer honeycomb panel that is breathable to allow perspiration removal and cooling of the apparatus user.

Another advantage of the present invention is that different thermoplastic elastomeric honeycomb core designs and/or multiple panels of different thermoplastic honeycomb core designs may be utilized to maximize design flexibility of the improved anatomical support apparatus.

Still another advantage of the present invention is that the thermoplastic elastomeric honeycomb core is fabricated from recyclable materials that are fast drying, and easily disinfected and sterilized.

These and other objects and advantages of the present invention will no doubt become apparent to those skilled in the art after having read the following detailed description of the preferred embodiments which are contained in and illustrated by the various drawing figures.

DETAILED DESCRIPTION OF THE EMBODIMENTS

Figure 1:
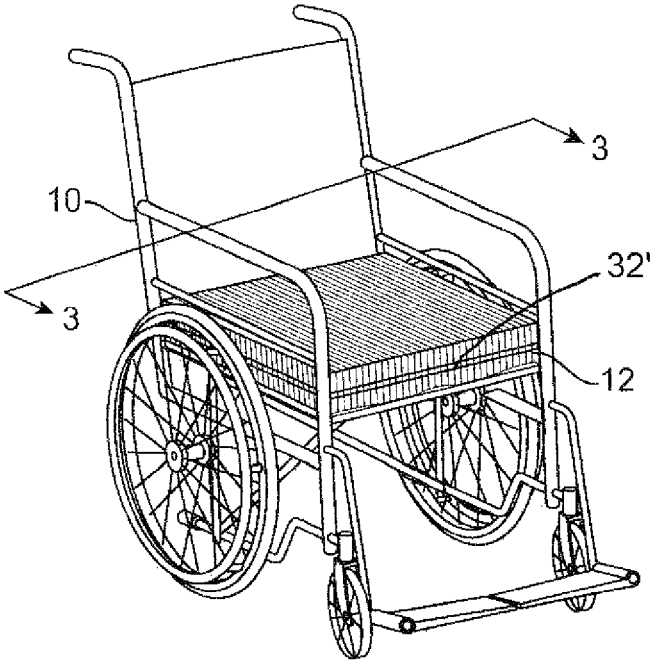
FIG. 1 is a perspective view generally illustrating a standard wheelchair having disposed thereon an improved anatomical support and seat cushion apparatus constructed in accordance with a presently preferred embodiment of the present invention.

Referring now to FIG. 1 of the Drawings which, as pointed out above, depicts a conventional wheelchair 10 having disposed thereon but shown without deformation, an adjustable, removable, improved anatomical support cushion assembly 12 enclosed in its fabric cover 30. As will be described in greater detail below, the cushion assembly 12 is constructed of at least one flexible thermoplastic elastomer honeycomb core panel built in accordance with the present invention. It should also be noted that although the cushion apparatus is particularly well suited for wheelchair applications, the cushion apparatus, or analogs thereof, may also be used in a variety of other anatomical support applications (e.g., mattresses, automobile and airline seats, arm rests, etc.).

Figure 2:
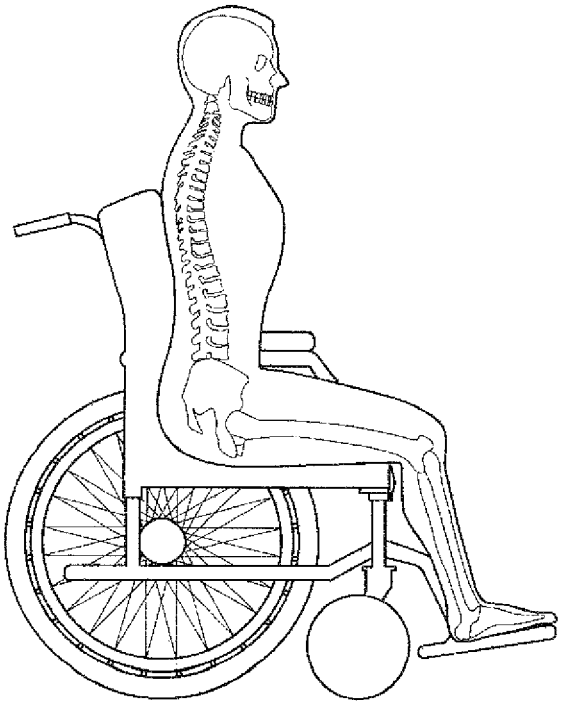
FIG. 2 is a stylized side elevational view illustrating an optimally postured patient sitting upright in a standard wheelchair of the type shown in FIG. 1.
Figure 3:
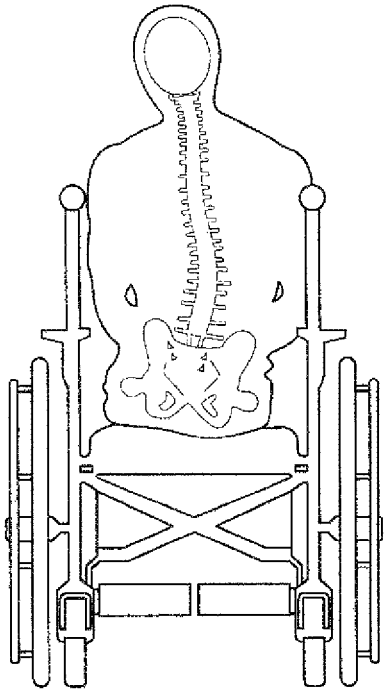
FIG. 3 is a stylized partial cross-sectional view taken along the line 3-3 of the wheelchair illustrated in FIG. 1, and a patient expressing pelvic obliquity abnormality to illustrate one example of a condition that can be addressed using an anatomical support and cushion apparatus in accordance with the present invention.
Figure 4:
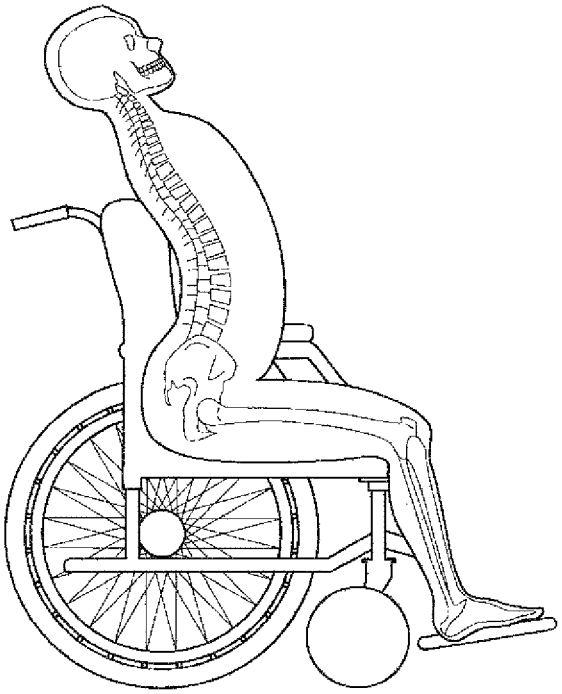
FIG. 4 is a stylized side elevational view illustrating a patient sitting in a standard wheelchair of the type shown in FIG. 1 and expressing an anterior pelvic tilt abnormality to illustrate another example of a condition that can be addressed using a cushion apparatus in accordance with the present invention.
Figure 5:
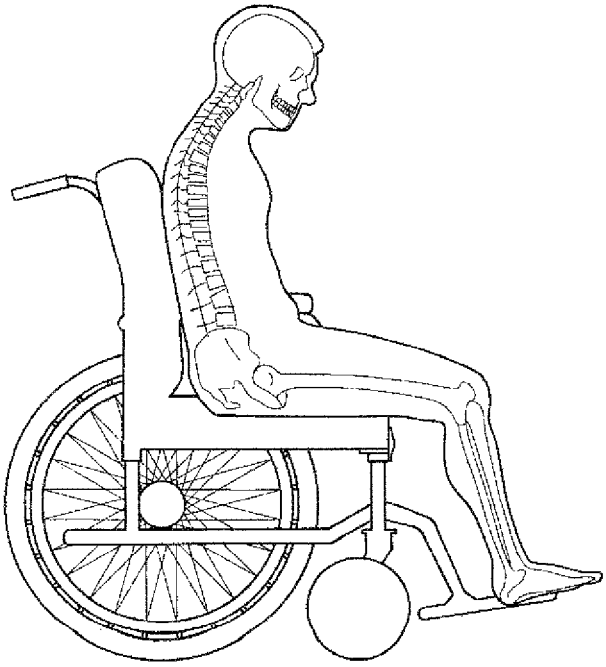
FIG. 5 is a stylized side elevational view illustrating a patient sitting in a standard wheelchair of the type shown in FIG. 1 and expressing a posterior pelvic tilt abnormality to illustrate another example of a condition that can be addressed using a cushion apparatus in accordance with the present invention.
Figure 6:
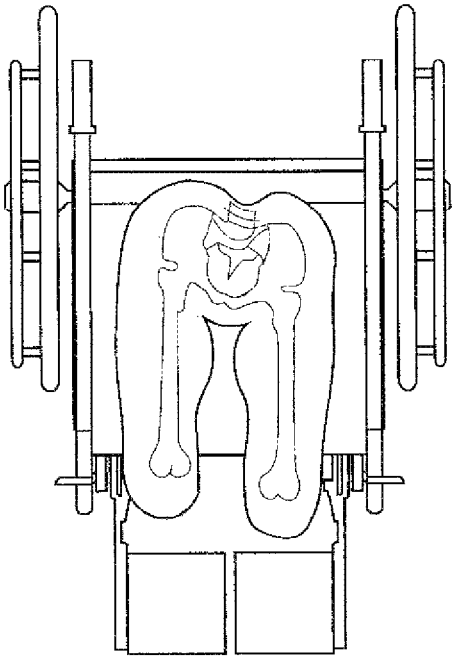
FIG. 6 is a partially broken plan view illustrating a patient sitting in a standard wheelchair of the type shown in FIG. 1 and expressing a pelvic rotation abnormality to illustrate another example of a condition that can be addressed using a cushion apparatus in accordance with the present invention.

FIG. 2 is provided to illustrate optimal user posture when seated in a standard wheelchair.

FIGS. 3-6 are provided to respectively illustrate abnormal postural conditions identified as pelvic obliquity, anterior pelvic tilt, posterior pelvic tilt and pelvic rotation; all of which are conditions that can be aided through use of the present invention.

Figure 7:
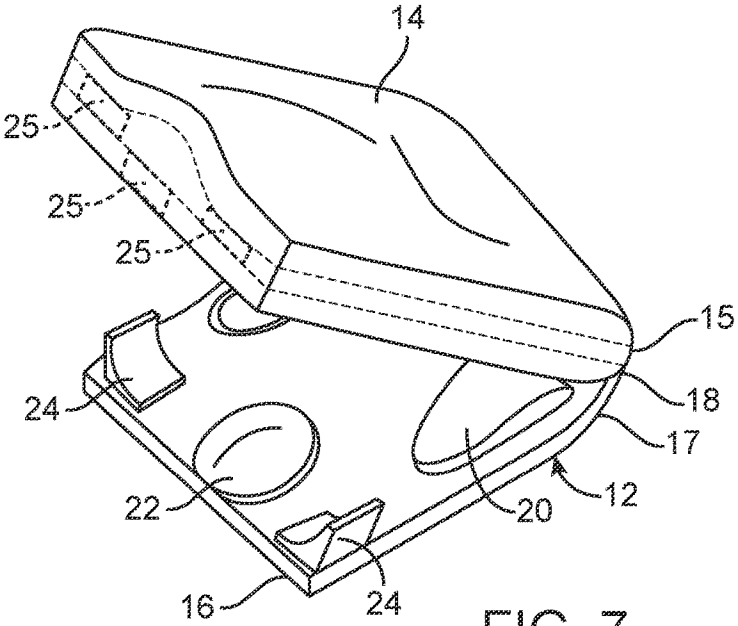
FIG. 7 is a stylized three-quarter view generally illustrating an adjustable anatomical support and cushion assembly, in its open configuration; the user supporting cushion member, the pivotally attached base member, and an assortment of obliquity elements, pommel elements and wedge elements all being disposed on the base member in accordance with an embodiment of the present invention.

FIG. 7 generally depicts the principal components of an adjustable wheelchair seat cushion assembly 12 in accordance with an embodiment of the present invention, and including a multi-layered resilient thermoplastic honeycomb cushion member 14 and a pivotally attached base member 16 (populated with cushion deforming elements 20, 24 and 26) forming a planar base upon which the upper cushion member 14 will rest when folded about a pivot or hinge means 18 to engage and lay upon the top of the cushion member 14 and one or more deforming elements 20, 22 and 24. Pivot means 18 is preferably a thermo-compressively formed bead-line disposed along mating rear edges 15 and 17 of the upper cushion member 14 and the base member 16, respectively. The base member 16 is preferably made of one or more layers of a more rigid thermoplastic honeycomb material.

Figure 10:
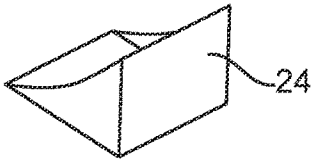
FIGS. 8-10 illustrate in 3-dimensional perspective, generalized examples of the obliquity elements, pommel elements, and wedge elements depicted in FIG. 7.
Figure 9:
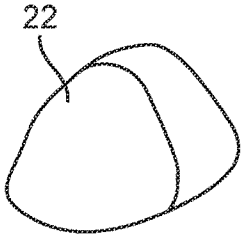
Figure 8:
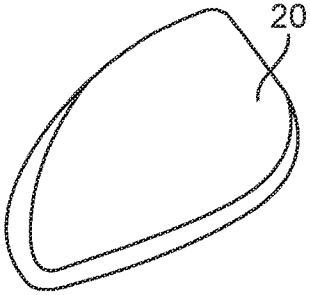

Positioned upon the base member 16 and disposed between it and the overlying cushion member 14 are user and/or LTC therapist installable, variously sized and shaped pelvic obliquity elements 20 (FIG. 8), pommel elements 22 (FIG. 9) and/or wedge elements 24 (FIG. 10) all of which are specifically shaped and sized, cushion deforming elements (perhaps prescriptively sized and shaped by an LTC therapist to address a particular user's condition), and intended to be operative to deform or adjust the support capability of the cushion member 14 in certain ways when it is engaged therewith. As suggested by the dashed lines 25 shown in FIG. 7, additional pockets may also be provided in cushion member 14 for receiving other cushion adjusting elements (not shown) that may also be inserted into the pockets to further deform the cushion member 14 to satisfy certain special needs of a user/patient.

Figure 12:
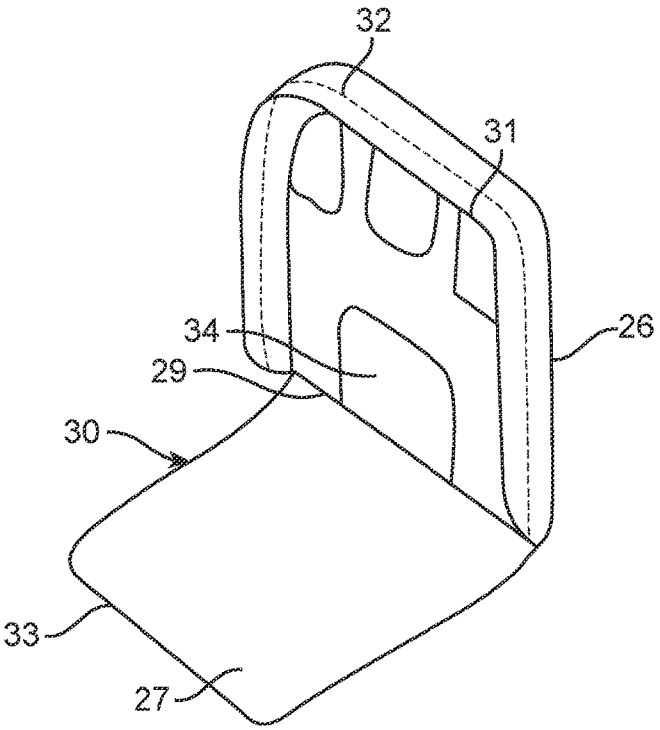
FIG. 12 is a stylized three-quarter perspective view generally illustrating, in its open configuration, a zippered cover envelope for receiving and containing the cushion assembly illustrated in FIG. 7.

Once the obliquity, pommel and/or wedge elements, or the like, are positioned on and affixed to the base member 16, (and perhaps other elements inserted into the pockets 25), the cushion member 14 may be rotated downwardly about the pivot or hinge means 18 into engagement therewith and deformed thereby, and the assembly is then ready for insertion into its protective cover 30 depicted in FIG. 12. It should be noted that the cushion "deformation" may be more or less visible depending upon the softness or resiliency of the cushion and the degree of anatomical adjustment required by the user.

The cover 30 is preferably made of a suitable fabric material and may include an upper shell-like part 26 and a mating bottom flap part 27. Once the cushion assembly 12 is fully assembled, it may be placed on the bottom flap part 27 of cover 30 and the upper shell-like part 26 can be rotated about its fold line 29 and into its closed position partially enveloping the cushion assembly 12. Closure of the cover 30 may then be completed by zipping an upper zipper part 31, disposed around the lower edge of the shell-like part 26, into engagement with a lower zipper part 33 disposed around the exposed perimeter of the bottom flap part 27. At this point the fully assembled cushion apparatus is ready to be placed upon the user/patient's wheelchair for use.

Figure 11:
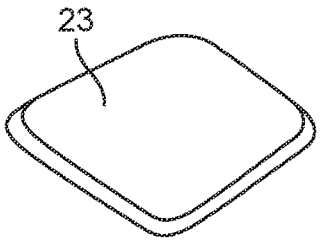
FIG. 11 is a perspective view generally illustrating an ischial pad of a configuration that might be installed in an appropriate location on the cushion assembly or in a pocket formed in its cover.

In some cases, use of an ischial pad 23 (preferably embodied in the form of another small honeycomb pad of a particular softness, or stiffness, and generally depicted in FIG. 11) may also be required to protect the user/patient's tailbone (ischial bone). To provide such protection, a suitably configured ischial pad 23 may be inserted into a pocket 34 provided in the back-center portion of the upper shell part 26 of cover 30 to protect the patient's ischial bone.

Note also that a second zipper facility 32, or the like, may be provided in cover 30 for permitting adjustment of the cover size (expanding or contracting) required to accommodate the number and/or size of the various deforming elements used in the cushion assembly.

Figure 13:
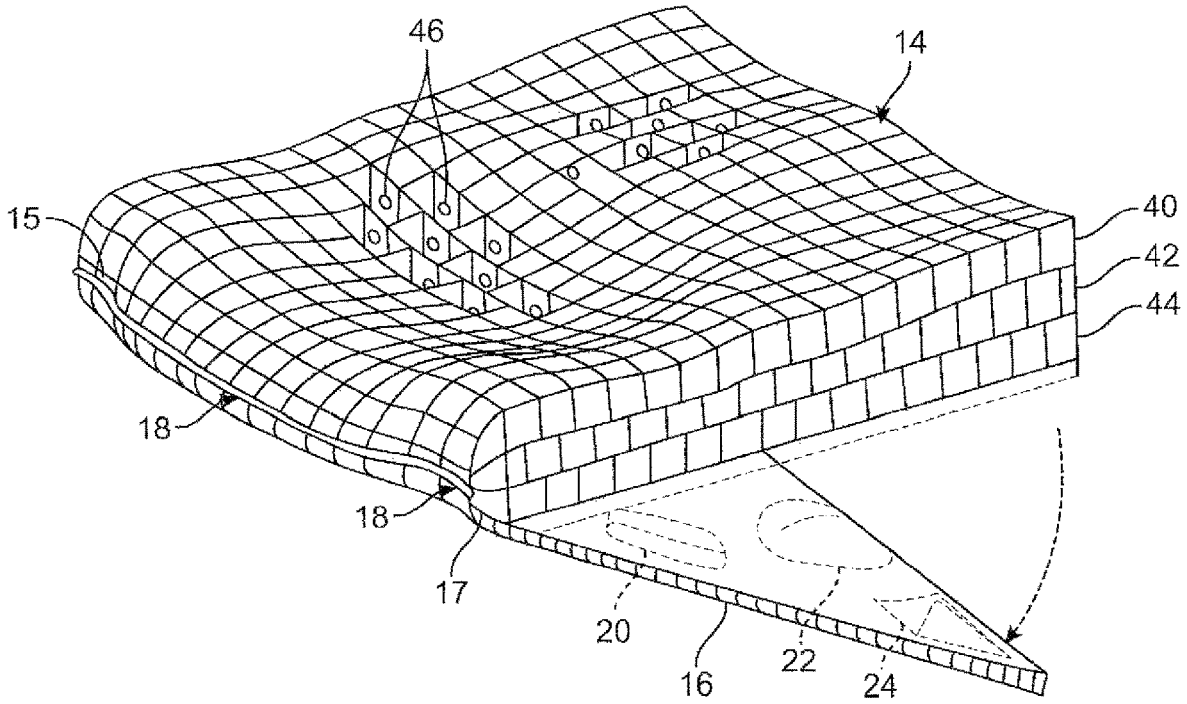
FIG. 13 is a stylized three-quarter perspective view, generally illustrating, in its open configuration, as viewed from the upper back side and opposite from that depicted in FIG. 7, of the user supporting cushion member and the pivotally attached base member, in accordance with an embodiment of the present invention.

In FIG. 13 a multi-layered cushion member, such as that disclosed in Applicant's prior U.S. Pat. No. 5,617,595 and fully incorporated herein by reference, is shown at 14. In accordance with the present invention, the cushion member 14 is shown modified to include a lower flap or base member 16 as described above. This example is provided to more clearly illustrate attachment of the flap edge 17 by thermo-compression bonding along the rear side of the cushion member. Alternatively, the flap edge may be otherwise attached to the upper cushion member 14.

FIG. 13 illustrates in more detail a particular embodiment of a multi-layered honeycomb seat cushion constructed using multiple panels or layers of thermoplastic elastomer honeycomb materials. In this embodiment, the upper cushion member 14 is comprised of 3 layers, or panels, 40, 42, 44. The panels each include a honeycomb-like core preferably made of bonded together and expanded strips or ribbons of plastic material to which facing sheets of perhaps heavier gauge material are thermo-compression bonded. The illustrated cushion member 14 is an anisotropic three-dimensional structure having predetermined degrees of flex along the X, Y and Z axes. Each cell is formed, in part, by four generally S-shaped wall segments of the strips or ribbons each of which is bonded to adjacent strips and shared by an adjacent cell. In addition, each cell shares a double thickness wall segment with two adjacent cells. Note also that as described in our incorporated prior patents, at least some of the strips and facing sheets may be perforated, as shown at 46, to render the cushion breathable and to allow perspiration removal and cooling of the user's body. Moreover, the thermoplastic elastomeric honeycomb materials from which the cushion is fabricated may be recyclable, fast drying, and easily disinfected and sterilized.

Cushion member 14 has high tear and tensile strength and is highly resilient, with optimal compression load and shock absorption or distortion characteristics, yet is extremely light weight. Selected combinations of elastomer material, honeycomb cell configurations, core thicknesses and facing material variables determine the panel's characteristics of softness or hardness, resilient recovery rate and rigidity or flex as required for a particular application. The facing materials can be selected from a wide variety of films, including thermoplastic urethanes, foams, EVAs, rubber, neoprene, elastomer impregnated fibers and various fabrics, etc. The manufacture and fabrication of honeycomb cushions of the type utilized in the present invention to make a cushion of the type embodied in applicant's cushion member 14 is described in our prior U.S. Pat. No. 5,039,567; the disclosure thereof being expressly incorporated herein by reference.

In accordance with the present invention, and as generally described above, the base member 16 is preferably made of at least one relatively thin sheet of more rigid honeycomb material, and has a rear edge 17 thereof hingedly connected to the back of the cushion member 14, preferably along it's rearmost extremity. Removably disposed between the base member 16 and the cushion member 14, and preferably attached, by suitable means, such as Velcro or other "hoop and loop materials" or the like, to the upper surface of the base member 16 at predefined locations, are one or more cushion deforming elements selected to define the user support characteristics of the cushion assembly. The cushion deforming elements may be generally described as an assortment of prescriptively sized and shaped pelvic obliquity elements 20, pommel elements 22 and/or wedge elements 24 as illustrated herein in FIGS. 8-10.

These elements are selected, positioned and secured by the user and/or assisting therapist or clinician on the upwardly facing base member surface so as to deform, or alter the support characteristics of the overlying resilient cushion member 14 to raise, lower, align, orient or otherwise adjust the user's skeletal components supported by the cushion assembly to provide pelvic and trunk stability, maximize the user's comfort and function during ADLs, protect the user's skin and prevent wounds, assist in the healing of existing wounds, minimize unwanted movement of the user on the cushion surface, correct or accommodate postural abnormalities and/or prevent or mediate progression of postural abnormalities.

As generally described below, these elements are adapted to deform the cushion member 14 as it is lowered (folded down) into supporting engagement therewith. The preformed obliquity elements 20, pommels 22 and/or wedges 24 are carefully selected and positioned to provide a desired customizing deformation or adjustment of the overlying cushion member 14 so that the cushion in turn provides the supporting needs of the user when the assembly is folded into its closed, or folded, configuration.

Once folded, the cushion assembly 12 is inserted into an enveloping fabric cover 30, such as that generally illustrated in FIG. 12, that is configured to conform to the shape of the cushion assembly and is provided with perimeter zippering means, or the like, to securely house the cushion assembly and maintain it in its closed and functional configuration. As pointed out above, the cover 30 may also be provided with internal and/or external pockets for receiving additional ischial pads, pommels or wedges, etc.

Figure 14:
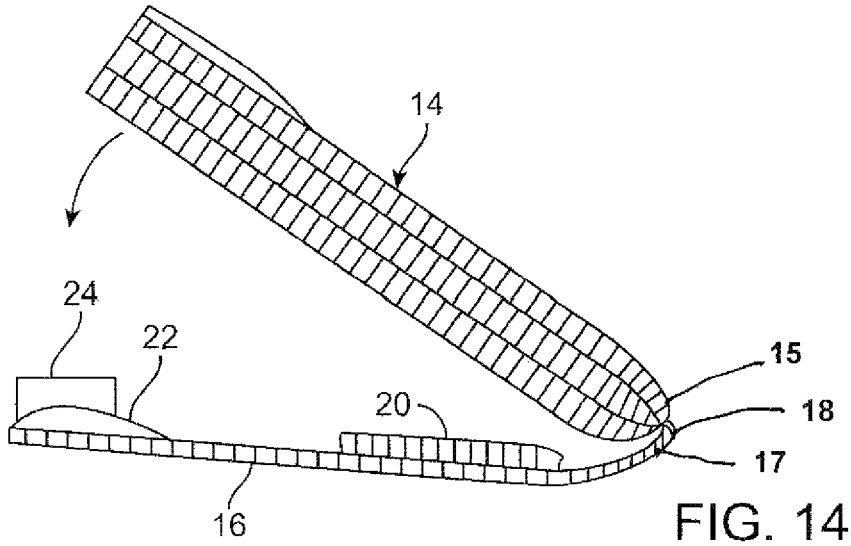
FIG. 14 is a side view of the cushion assembly of FIG. 13 depicted in its open configuration.
Figure 15:
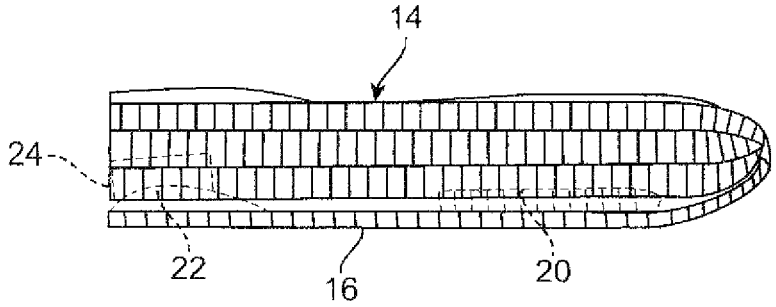
FIG. 15 is a side view of the cushion assembly of FIG. 13 depicted in its closed configuration.

In FIGS. 14 and 15, side views of the above described cushion assembly 12 in its open and closed configurations are shown in more detail.

Figure 16:
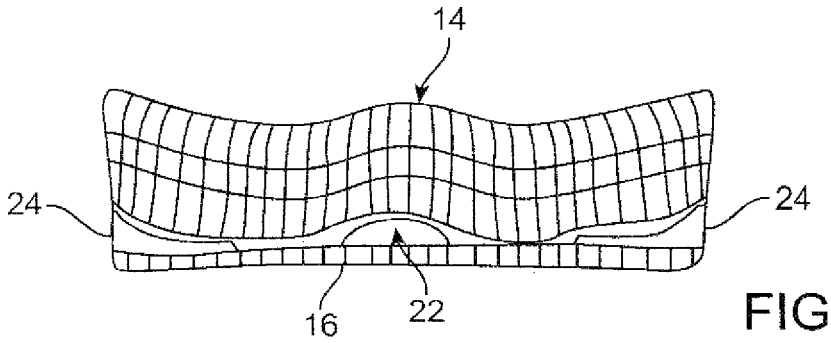
FIG. 16 is a frontal view showing the cushion assembly of FIG. 13 depicted in its closed configuration.

In FIG. 16 a frontal view is depicted in somewhat exaggerated perspective to emphasize the distortion of the cushion member 14 by the several underlying elements.

Figure 17:
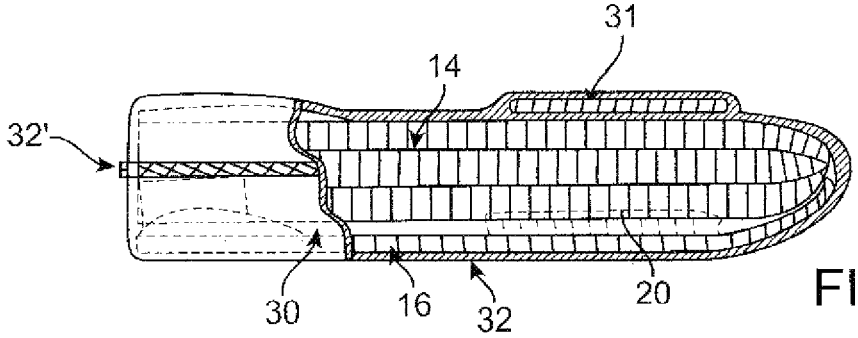
FIG. 17 is a partially broken side view showing the closed cushion assembly of FIG. 13 enveloped in its zippered cushion assembly cover depicted in FIG. 12.

And finally, in FIG. 17, a partially broken side view of the fully assembled anatomical support and seat cushion apparatus is shown further illustrating the cushion assembly 12 disposed within its fabric cover 30. Note that a closing zipper 31, 33 is provided around three sides of the lower edge of the cover, and a second, medially disposed expansion zipper and excess material facility 32 is suggested to accommodate an assembly of larger or smaller cushion deforming elements should that be necessary.

Although embodiments of the present invention have been disclosed above, it will be appreciated that numerous alterations and modifications thereof will no doubt become apparent to those skilled in the art after having read the above disclosure. For example, the anatomical support cushions may be configured in any appropriate shape, with multiple panels and with various combinations of perforated and non-perforated core panels, and with core walls and/or face sheet perforations the number and/or hole size of which are tailored to achieve desired damping, cleaning and sanitizing characteristics. In addition, means other than the disclosed thermo-compression bead and closable cover can be provided for holding the several components in engaging relationship after the deforming elements have been attached to the base member and brought into deforming engagement with the cushion member. It is therefore intended that the following claims may be interpreted as covering all such alterations and modifications as fall within the true spirit and scope of the invention.

The invention claimed is:

1. An adjustable anatomical support and seat cushion apparatus for wheelchairs, comprising:

a generally rectangular, resilient seat cushion member formed of a plurality of layers of thermoplastic honeycomb material;

a generally rectangular, planar base member formed of at least one layer of a thermoplastic honeycomb material, the base member being disposed beneath the seat cushion member and having an edge thereof pivotally attached to a corresponding edge of the seat cushion member at a hinge, the seat cushion member being rotatable between a non-parallel disposition relative to the base member, and a parallel disposition relative to the base member, wherein the at least one layer of thermoplastic honeycomb material of the base member is more rigid than the plurality of layers of thermoplastic honeycomb material of the seat cushion member; and at least one cushion deforming element configured to be affixed to a surface of the base member generally facing the seat cushion member, the at least one cushion deforming element being operative to engage and deform the seat cushion member when the seat cushion member is rotated from the non-parallel disposition relative to the base member into the parallel disposition relative to the base member, the at least one cushion deforming element being removable from the base member.

2. The adjustable anatomical support and seat cushion apparatus for wheelchairs, as recited in claim 1 wherein back edges of the seat cushion member and the base member are hingedly coupled together, and the base member further comprises a front edge and left and right side edges respectively connecting the front and back edges, and wherein at least one cushion deforming element is a pelvic obliquity element disposed on the base member in a position proximate the back edge and one of the side edges of the base member, is a pommel element disposed on the base member in a position proximate to the front edge and midway between the left and right side edges of the base member, and/or a wedge element disposed on the base member in a position proximate the front edge and one of the left and right side edges of the base member.

3. The adjustable anatomical support and seat cushion apparatus for wheelchairs, as recited in claim 1 and further comprising a cover removably disposed about the seat cushion member, the at least one cushion deforming element, and the base member when the seat cushion member and the base member are in the parallel disposition.

4. The adjustable anatomical support and seat cushion apparatus for wheelchairs, as recited in claim 3 wherein the cover includes an opening configured to allow the seat cushion member, the at least one cushion deforming element, and the base member to be inserted into the cover, and a closure disposed about the opening and configured to allow the seat cushion member, the at least one cushion deforming element, and the base member to be closedly enveloped within the cover.

5. The adjustable anatomical support and seat cushion apparatus for wheelchairs, as recited in claim 1 wherein cell walls of the thermoplastic honeycomb material of at least one layer of the seat cushion member are perforated.

6. An adjustable anatomical support and seat cushion apparatus for wheelchairs, comprising:

a generally planar, rectangular base member having a first planform with a back edge, a front edge and left and right side edges respectively connecting the front and back edges, the base member being formed of at least one layer of thermoplastic honeycomb material;

a generally rectangular and resilient cushion member having a second planform substantially congruent with the first planform and disposed in overlying relationship to the base member, the cushion being formed of a plurality of layers of a thermoplastic honeycomb material, the cushion member being pivotally attached along a back edge thereof to the back edge of the base member at a thermo-compressively formed hinge, and rotatable between a non-parallel disposition relative to the base member and a parallel disposition relative to the base member; and at least one cushion deforming element configured to be affixed to a surface of the planar base member generally facing the cushion member, the at least one cushion deforming element being operative to engage and deform the cushion member when the cushion member is rotated from the non-parallel disposition relative to the base member into the parallel relative to the base member, the at least one cushion deforming element being removable from the base member.

7. The adjustable anatomical support and seat cushion apparatus for wheelchairs, as recited in claim 6 wherein the at least one cushion deforming element is a wedge element and is disposed on the base member in a position proximate the front edge and one of the side edges.

8. The adjustable anatomical support and seat cushion apparatus for wheelchairs, as recited in claim 6 and further comprising:

a cover removably disposed about the cushion member, the base member and the at least one cushion deforming element when the cushion member is disposed in parallel disposition relative to the base member.

9. The adjustable anatomical support and seat cushion apparatus for wheelchairs, as recited in claim 6 wherein the at least one cushion deforming element is a pelvic obliquity element and is disposed on the base member in a position proximate the back edge and one of the side edges.

10. The adjustable anatomical support and seat cushion apparatus for wheelchairs, as recited in claim 6 wherein the at least one cushion deforming element is a pommel element and is disposed on the base member in a position proximate to the front edge and midway between the side edges.

11. The adjustable anatomical support and seat cushion apparatus for wheelchairs, as recited in claim 6 wherein the at least one layer of thermoplastic honeycomb material of the base member is more rigid than the plurality of layers of thermoplastic honeycomb material of the cushion member.

12. The adjustable anatomical support and seat cushion apparatus for wheelchairs, as recited in claim 11 wherein cell walls of the thermoplastic honeycomb material of at least one layer of the cushion member are perforated.

13. An adjustable anatomical support and seat cushion apparatus for wheelchairs, comprising:

a generally rectangular, resilient cushion member formed of a plurality of layers of thermoplastic honeycomb material;

a generally rectangular, planar base member formed of at least one layer of a thermoplastic honeycomb material, the base member being disposed beneath the cushion member and having an edge thereof pivotally attached to a corresponding edge of the cushion member at a hinge, the cushion member being rotatable between a non-parallel disposition relative to the base member, and a parallel disposition relative to the base member, wherein the at least one layer of thermoplastic honeycomb material base member is more rigid than the plurality of layers of thermoplastic honeycomb material of the cushion member; and a pad configured to be positioned within a pocket of the cushion member facing the base member, the pad being removable from the pocket of the cushion member.

14. The adjustable anatomical support and seat cushion apparatus for wheelchairs, as recited in claim 13 and further comprising a cover removably disposed about the cushion member, the pad, and the base member when the cushion member and the base member are in the parallel disposition.

15. The adjustable anatomical support and seat cushion apparatus for wheelchairs, as recited in claim 14 wherein the cover includes an opening configured to allow the cushion member, the pad, and the base member to be inserted into the cover, and a closure disposed about the opening and configured to allow the cushion member, the pad, and the base member to be closedly enveloped within the cover.

16. The adjustable anatomical support and seat cushion apparatus for wheelchairs, as recited in claim 13 and further comprising at least one cushion deforming element configured to be affixed to a surface of the base member generally facing the cushion member, the at least one cushion deforming element being operative to engage and deform the cushion member when the cushion member is rotated from the non-parallel disposition relative to the base member into the parallel disposition relative to the base member, the at least one cushion deforming element being removable from the base member.

17. The adjustable anatomical support and seat cushion apparatus for wheelchairs, as recited in claim 16 and further comprising a cover removably disposed about the cushion member, the pad, at least one cushion deforming element, and the base member when the cushion member and the base member are in the parallel disposition.

18. An adjustable anatomical support and seat cushion apparatus for wheelchairs, comprising:

a generally rectangular, resilient cushion member formed of a plurality of layers of thermoplastic honeycomb material;

a generally rectangular, planar base member formed of at least one layer of a thermoplastic honeycomb material, the base member being disposed beneath the cushion member and having an edge thereof pivotally attached to a corresponding edge of the cushion member at a at a thermo-compressively formed hinge, the cushion member being rotatable between a non-parallel disposition relative to the base member, and a parallel disposition relative to the base member; and a pad configured to be positioned within a pocket of the cushion member facing the base member, the pad being removable from the cushion member.

19. The adjustable anatomical support and seat cushion apparatus for wheelchairs, as recited in claim 18 and further comprising a cover removably disposed about the cushion member, the pad, and the base member when the cushion member and the base member are in the parallel disposition.

20. The adjustable anatomical support and seat cushion apparatus for wheelchairs, as recited in claim 19 wherein the cover includes an opening configured to allow the cushion member, the pad, and the base member to be inserted into the cover, and a closure disposed about the opening and configured to allow the cushion member, the pad, and the base member to be closedly enveloped within the cover.

21. The adjustable anatomical support and seat cushion apparatus for wheelchairs, as recited in claim 18 and further comprising at least one cushion deforming element configured to be affixed to a surface of the base member generally facing the cushion member, the at least one cushion deforming element being operative to engage and deform the cushion member when the cushion member is rotated from the non-parallel disposition relative to the base member into the parallel disposition relative to the base member, the at least one cushion deforming element being removable from the base member.

22. The adjustable anatomical support and seat cushion apparatus for wheelchairs, as recited in claim 21 and further comprising a cover removably disposed about the cushion member, the pad, at least one cushion deforming element, and the base member when the cushion member and the base member are in the parallel disposition.

* * * * *